US008407964B1

(12) United States Patent
Roy

(10) Patent No.: US 8,407,964 B1
(45) Date of Patent: Apr. 2, 2013

(54) BUILDING CONSTRUCTION METHOD

(76) Inventor: Eric Roy, Yelm, WA (US)

( * ) Notice: Subject to any disclaimer, the term of this patent is extended or adjusted under 35 U.S.C. 154(b) by 251 days.

(21) Appl. No.: 12/707,268

(22) Filed: Feb. 17, 2010

(51) Int. Cl.
*E04B 1/00* (2006.01)
*E04G 21/00* (2006.01)
*E04G 23/00* (2006.01)

(52) U.S. Cl. ..... 52/745.02; 52/239.3; 52/294; 52/309.4; 52/309.16; 52/404.1; 52/408

(58) Field of Classification Search ..... 52/745.02, 52/293.3, 143, 294, 309.4, 309.7, 309.12, 52/309.14, 79.1, 741.1, 295, 408, 309.9, 52/309.16, 404.1
See application file for complete search history.

(56) References Cited

U.S. PATENT DOCUMENTS

| | | | | |
|---|---|---|---|---|
| 4,370,934 | A | 2/1983 | Haussler | |
| 4,501,098 | A * | 2/1985 | Gregory | 52/79.1 |
| 4,512,120 | A * | 4/1985 | Lindal | 52/79.1 |
| 4,622,788 | A | 11/1986 | Paulsson et al. | |
| 4,788,802 | A | 12/1988 | Wokas | |
| 5,402,618 | A * | 4/1995 | Biffis et al. | 52/745.02 |
| 5,622,198 | A | 4/1997 | Elsinger | |
| 5,706,615 | A * | 1/1998 | Bridges et al. | 52/105 |
| 5,724,774 | A | 3/1998 | Rooney | |
| 5,740,858 | A * | 4/1998 | Ingram | 165/56 |
| D443,732 | S | 6/2001 | Gelhar | |
| 6,253,504 | B1 * | 7/2001 | Cohen et al. | 52/143 |
| 6,298,619 | B1 * | 10/2001 | Davie | 52/293.3 |
| 6,510,659 | B2 | 1/2003 | Boyer et al. | |
| 6,584,749 | B2 * | 7/2003 | Sperber | 52/742.1 |
| 6,920,721 | B2 * | 7/2005 | Johns et al. | 52/79.1 |
| 7,594,361 | B2 | 9/2009 | Tragant Ruano | |
| 2001/0037615 | A1 | 11/2001 | Riech | |

* cited by examiner

*Primary Examiner* — William Gilbert
*Assistant Examiner* — Chi Q Nguyen
(74) *Attorney, Agent, or Firm* — Joseph Z. Ellsworth

(57) ABSTRACT

A method that streamlines concrete building construction and marketing of the building. Prefabrication units are designed and constructed in a controlled environment at a prefabrication factory using familiar, off the shelf components already used in the concrete construction industry. The method has allows one to build the prefabrication unit, which is 90% of the structure in the factory, with the remaining 10%, including the external walls and final utility connections, at the building site. Also because the prefabricated structures are light-weight and pre-finished structures, on-site installation is easier. With the prefabrication units completed at the factory, plumbing, heating and electrical and finishing can be tested and corrected while complete access is still available in the earlier stages of construction. Plumbing, electrical, heating tradesmen and subsequent inspectors visit the building site only for hook-up and inspection.

16 Claims, 9 Drawing Sheets

BUILDING CONSTRUCTION METHOD

BACKGROUND

1. Field of the Invention

This invention relates to building construction and more specifically to building construction methods that employ prefabrication complementing on-site construction.

2. Prior Art

Prefabricated building construction is well known, including prefabricated homes that are fully constructed in a factory and then shipped to a desired location for installation. Multiple units can be combined on site to result in a building larger than a single unit, which is limited in size to that which can be transported on a truck. Concrete structures are also known. One method is to pour concrete into slab panels at a manufacturing site, transport the panels to the building site and crane the panels together to form the desired shape of the structure. In most cases this method has proved not to be cost effective. Therefore, due to the weight and fragility of concrete panels, most concrete structures are cast on site, which typically means that forms are built and set into a framework and the concrete is poured into the formwork at the building site. The structure is then lifted by a crane into place.

Concrete castings, onsite and offsite, may include some utilities but generally they comprise only basic conduits and pipes needed for the project. Additional utilities are still needed. Installing these additional utilities requires the trades and inspectors to visit the site several times, which adds cost to the construction project.

Previous concrete construction methods typically pour the concrete walls first before other trades perform their work. As a result the framers, plasters, electricians, plumbers, heating contractors and other trades are required to work around and with the already poured structures which in most cases are not perfect. This usually results in mistakes being made, more labor, inspections and in the end more money.

A facility built with concrete walls installed first and following trades later also cannot be previewed. One can only look at plans or examples of previous projects.

The object of the present invention is therefore to provide a method of building construction that is amenable to construction of substantially all of a building inside of external walls (hereinafter "prefabrication unit") prior to construction or installation of the external walls. It is a further object that the method include prefabrication of a prefabrication unit at a site remote from the building site (the site where the building will be permanently located) and transporting the prefabrication unit to the building site. It is still another object that construction of the prefabrication unit provides access to tradesmen for construction of the prefabrication unit at a site remote from the building site such that the tradesman may complete their work during a single visit to the prefabrication site of the prefabrication unit. It is another object that any prefabricated portion of the building be lightweight to facilitate ease of transport to the building site. It is yet another object that the construction of the building be amenable to installation of concrete walls at the building site after the prefabrication unit is completed or substantially completed. It is a yet further object the concrete walls be poured in place (as opposed to poured on a form on the ground and lifted into place) without causing damage to the prefabrication unit. It is a further object that the prefabrication unit be able to be previewed by customers of their purchased unit prior to installation at their building site and by potential customers at a location remote from the building site, such as dealership 'showrooms,' for marketing purposes.

SUMMARY

These object are achieved in a method that results in streamlining construction and marketing of the building product. The prefabrication units are designed and constructed in a controlled environment at a prefabrication factory using familiar, off the shelf components already used in the concrete construction industry. Tradesman complete all or substantially all of their work at the factory, even in parallel with each other, in a comfortable environment, with full access to all parts of the prefabrication unit without conflicts of access between the tradesman, therein making their work more efficient such their work is completed at once at the factory, which also results in a higher standard of work and therefore a higher quality in the resulting building. The method allows one to build the prefabrication unit, which is 90% of the structure in the factory, with the remaining 10%, including the external walls and final utility connections, at the building site after the prefabrication unit has been shipped. Also because the structures are light-weight and pre-finished structures, on-site installation is easier.

With the prefabrication units completed at the factory, plumbing, heating and electrical and finishing can be tested and corrected while complete access is still available in the earlier stages of construction. Work is more easily scheduled. Plumbing, electrical, heating tradesmen and subsequent inspectors visit the building site only once.

Different from other prefabrication construction, such as prefabricated homes of wood and/or siding and/or stucco, the final construction includes durable external walls that do not deteriorate over time, such as concrete or brick, which are added to the prefabrication unit on the building site.

Conventional construction typically begins with a foundation and then floor joists are installed over the foundation. Wall studs and ceiling joists are then added followed by external walls and a roof to result in a closed external unit. Plumbing, heating, ducting and electrical work are then added to the external unit. Floors and wall board follow the plumbing and electrical work. Finishing work including floor coverings, cabinets, sinks, doors and lighting complete the construction.

Previously, the conventional method of construction has been followed out of necessity. Concrete walls could not be poured in place around and directly against a prefabrication unit without causing damage to the electrical wiring and fixtures, the plumbing, wallboard and studs. The present method overcomes this limitation by employing spray foam around the prefabricated prefabrication unit after the prefabrication unit is completed that hardens to protect the wiring and plumbing from the concrete and therefore anything inside the foam. After the foam is sprayed between the studs and hardens, it becomes a hard and rigid primary structural component therein giving the wallboard or paneling strength that the prefabrication unit needs to sustain concrete being poured against it until the concrete dries. (For these purposes, for ease of description wallboard is deemed to include drywall, paneling, wood, plastics, composites and any other form of wall covering.)

Imbedding standard electrical wires in the foam protects them from the concrete and day to day use. In other concrete structures you would run wires in conduit or in fir-out walls, crawl or attic spaces. Embedding the plumbing, vents and miscellaneous items in the foam makes construction quicker, cheaper, and less complex and uses fewer parts.

Although the buildings often are considered in regard to pre-fabricated concrete structures that are mainly used as security shelters ("safe rooms", bomb or storm shelters) the construction method is equally suitable for residential concrete homes and any other construction of buildings.

Advantages of this method of construction are several. It allows a manufacturer to prefabricate a completely functioning living unit in a factory remote from a final building site except its foundation, exterior walls, and roof, which leaves the prefabricated unit light weight for transporting. Although the method is applicable for various exterior building constructions, it is especially useful for concrete structures, that is, structures having a concrete foundation, concrete walls and concrete walls. Such structures are used for examples as normal living quarters, utility buildings, shelters, safes and vaults, banks and incarceration rooms. Such concrete structures are too heavy in practice to be prefabricated and then transported at a minimum transportation cost. This method allows the functioning portion of the units to be prefabricated with the foundations, walls and roofs to be installed at the final building location in a single concrete pour. Inspections are also completed in a single visit. This facilitates a fast on-site installation time, eliminates cost overruns, no garbage or piles at the installation site, no transportation of fragile concrete precast slabs, no transport of extreme weights, no requirement of heavy lifting cranes, no time delays to allow for curing times for example for paint and concrete. It also facilitates a complete systems check at the prefabrication factory where corrects can be implemented easily and quickly where all parts of the system are still readily accessible. No concrete needs to be drilled and no wallboard needs to be removed and patched in order to make a correction. It also allows for an interested buyer to preview optional structures and even to preview his actual structure at the prefabrication factory or a dealership.

DETAILED DESCRIPTION OF THE PREFERRED EMBODIMENTS

Figure 1:
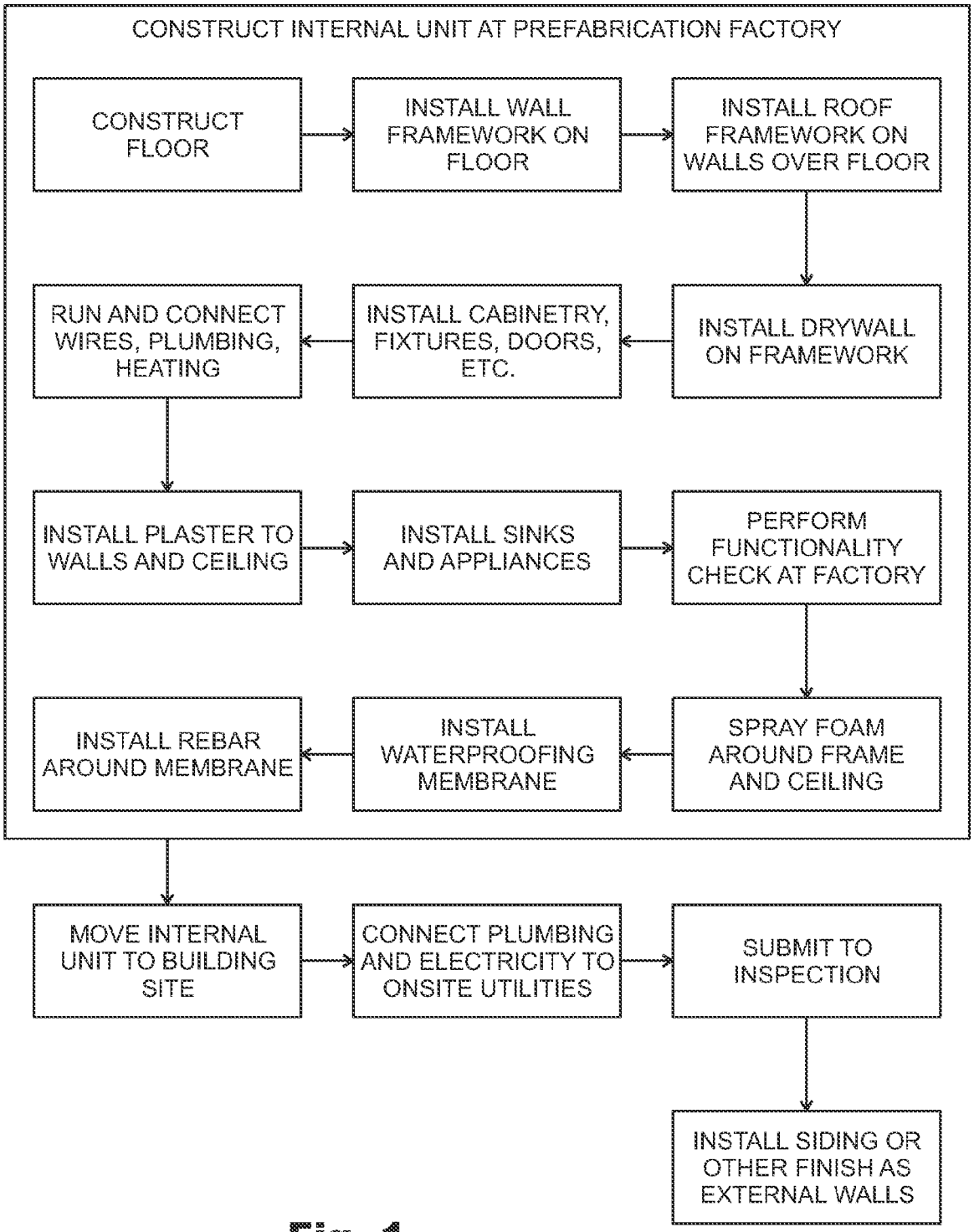
FIG. 1 is a block diagram of the steps for constructing a concrete building according to the present invention.
Figure 2:
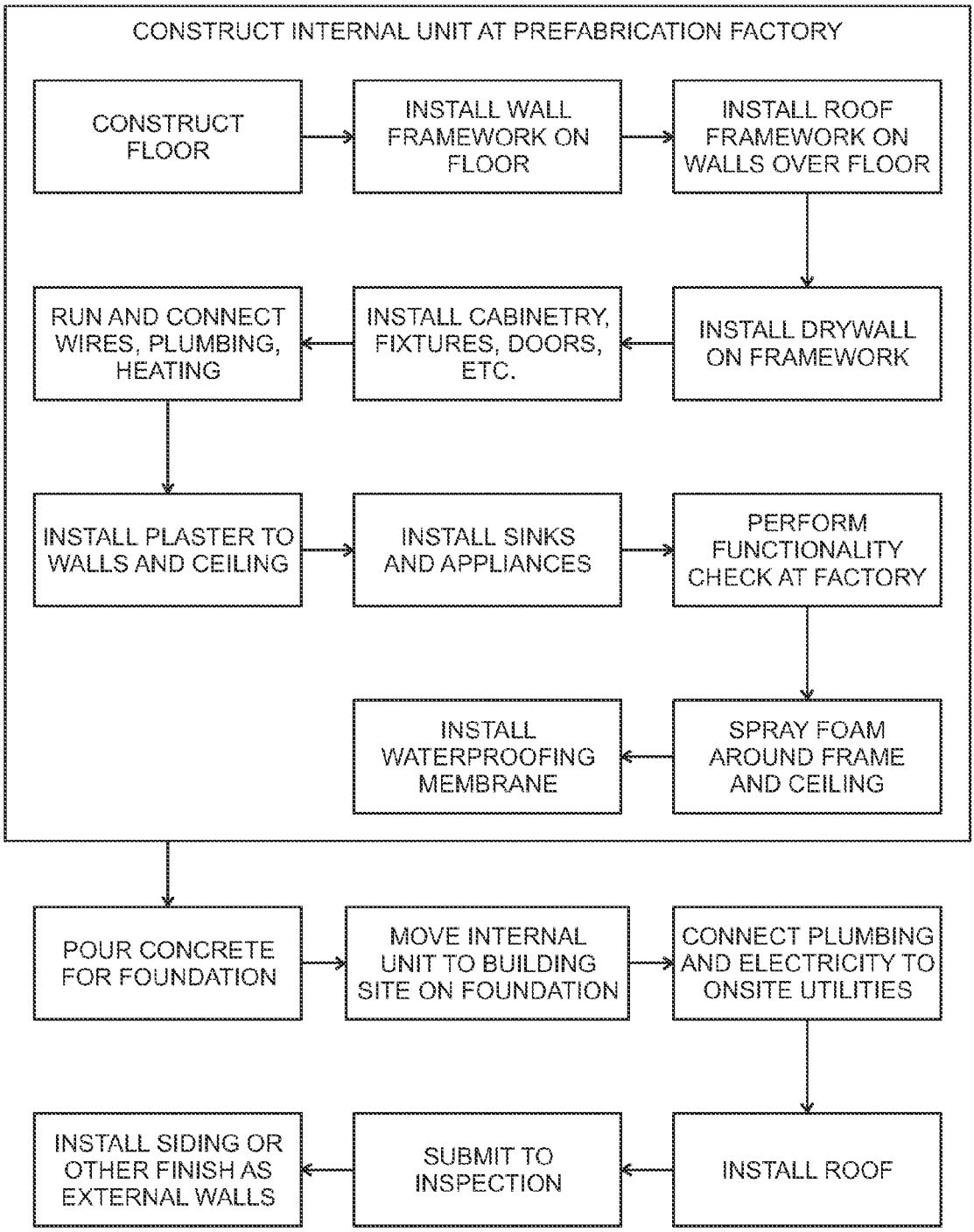
FIG. 2 is a detailed block diagram showing steps for construction a non-concrete building according to the present invention.
Figure 3:
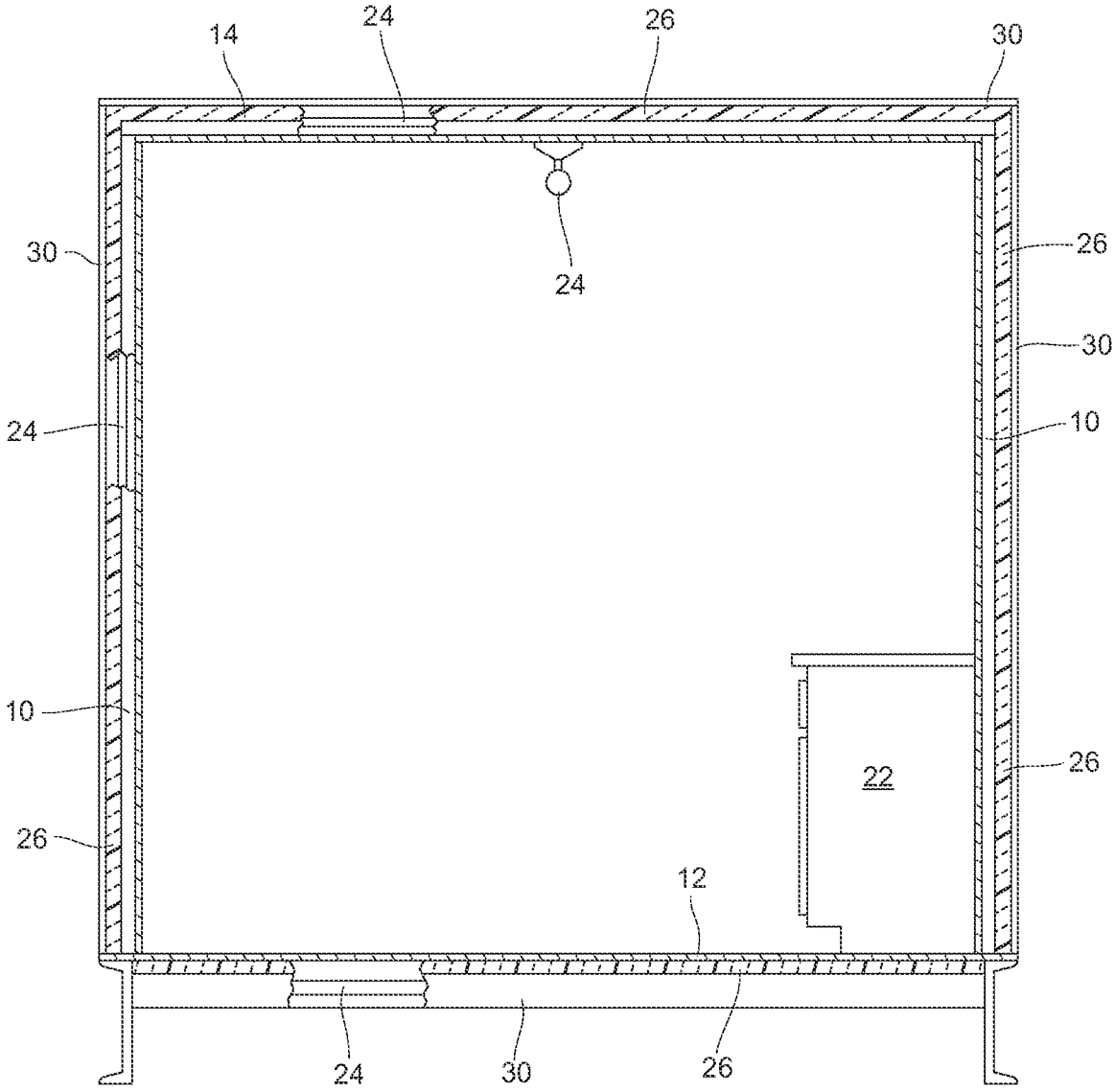
FIG. 3 is a front cut-away view of a prefabrication unit of the present invention.
Figure 4:
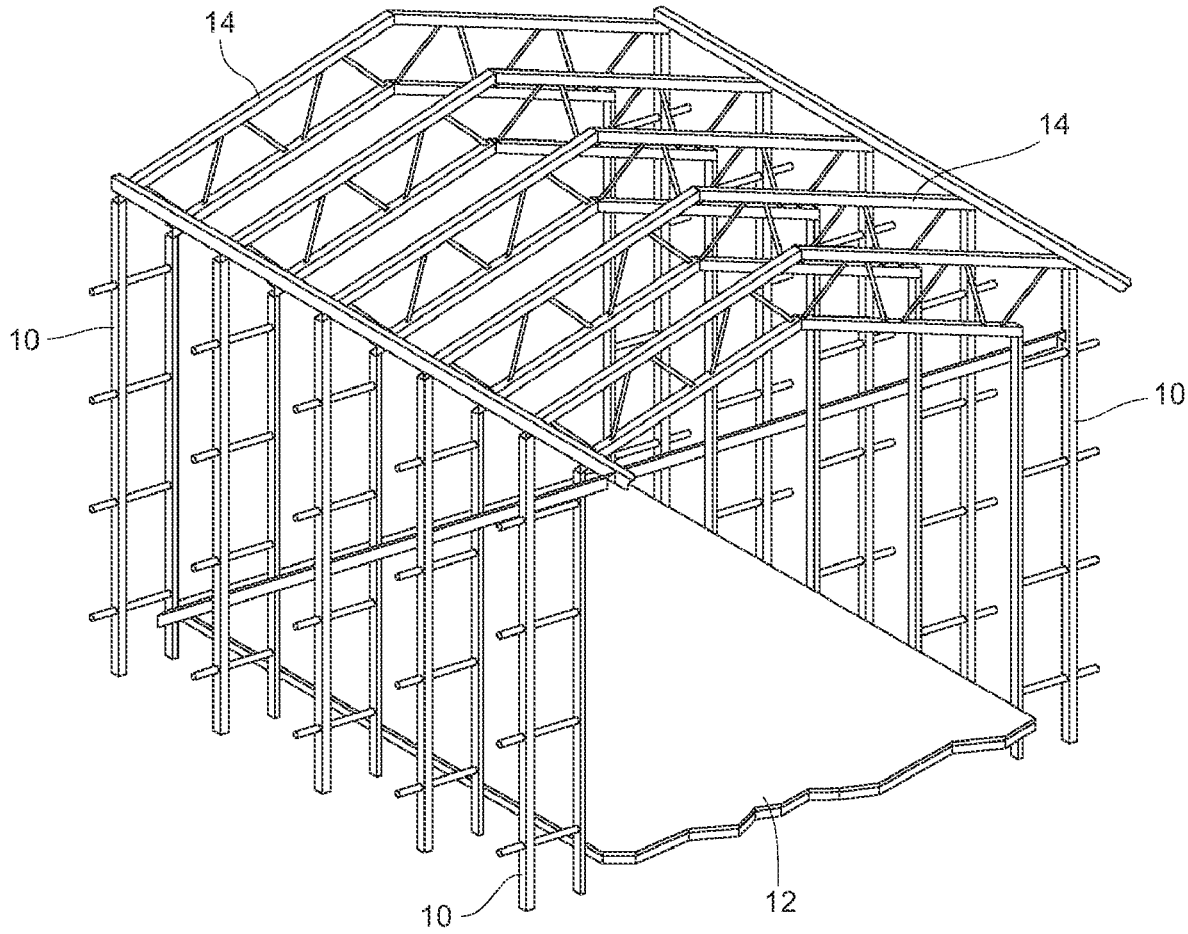
FIG. 4 is a perspective view of a building frame formed of metal studs and joists.
Figure 5:
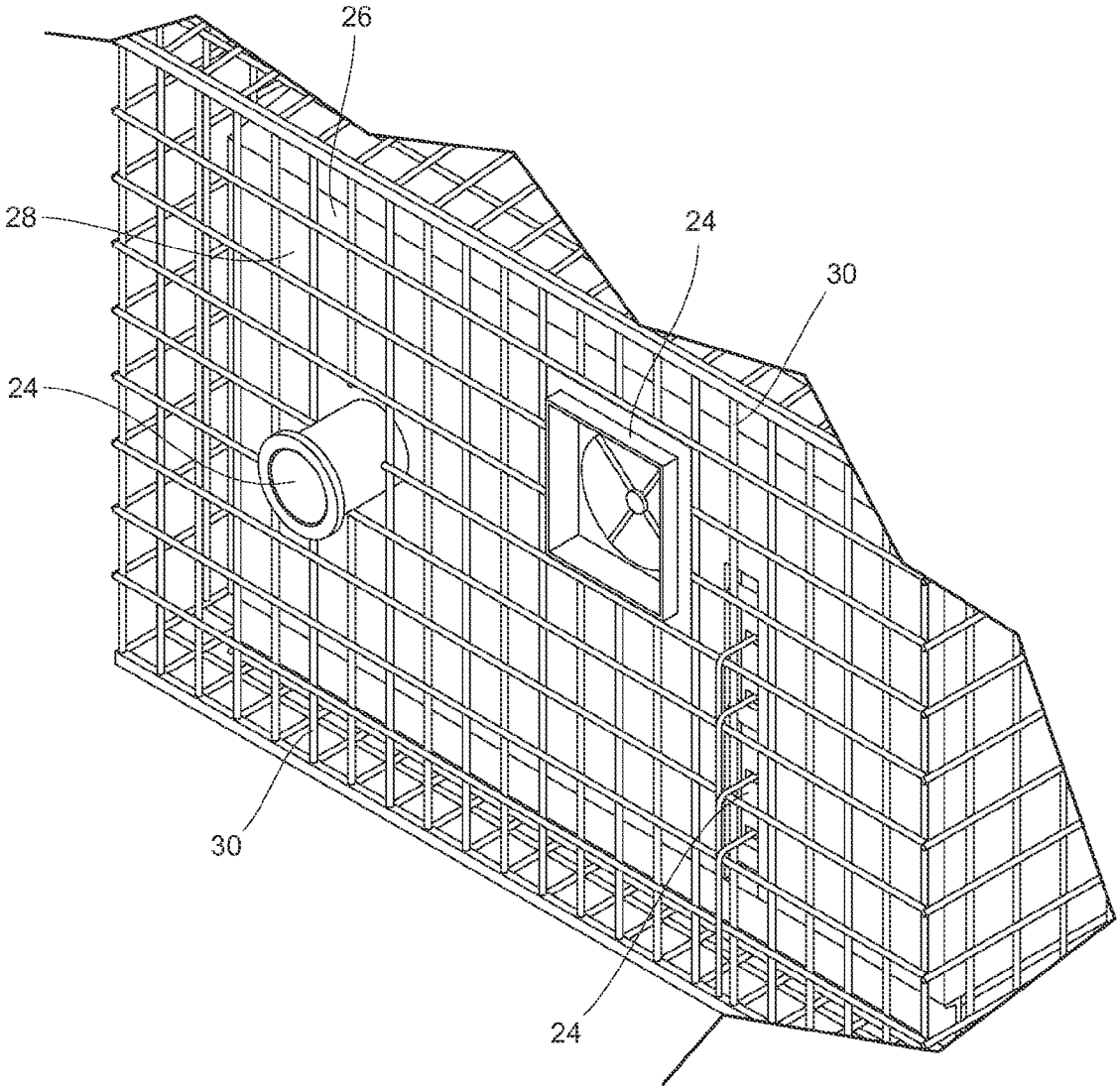
FIG. 5 is an artistic view of side of a building prefabrication unit showing reinforcing bars installed around foam.
Figure 6:
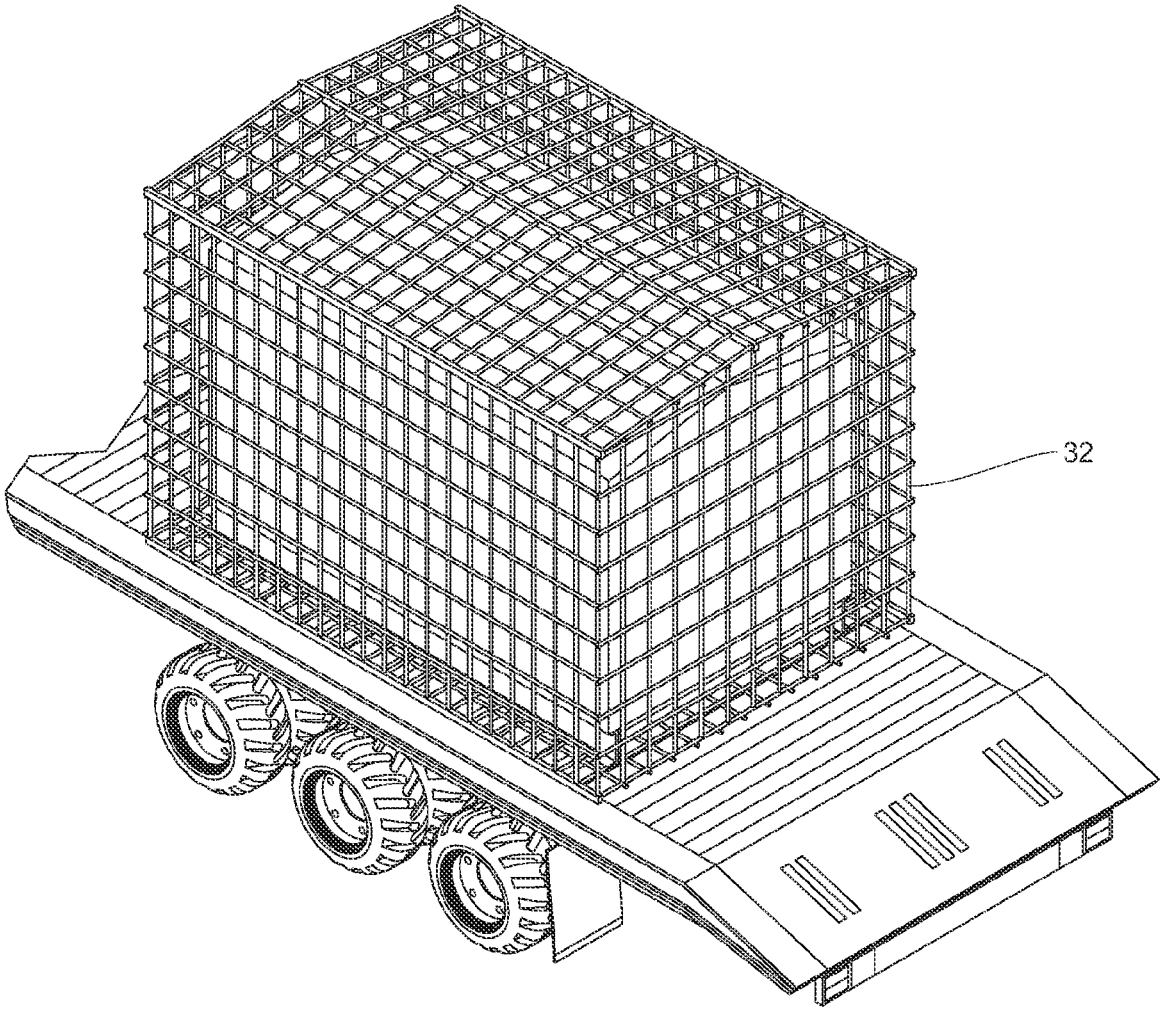
FIG. 6 is a perspective view of a building prefabrication unit being transported.
Figure 7:
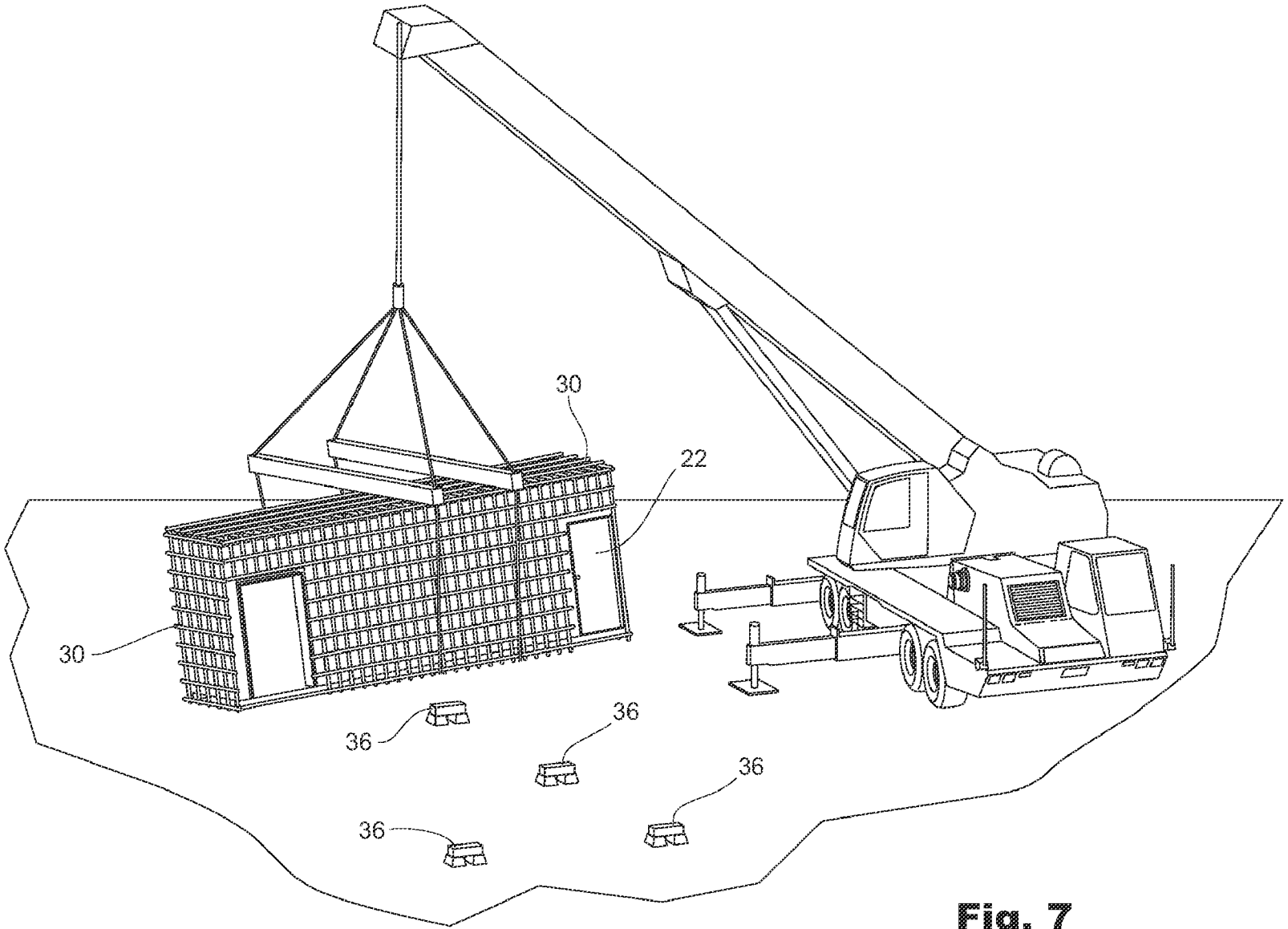
FIG. 7 is a perspective view of a prefabrication unit being set onto footings that support the prefabrication unit above the ground, which allows concrete to flow within concrete formwork along and outside of the walls of the prefabrication unit.
Figure 8:
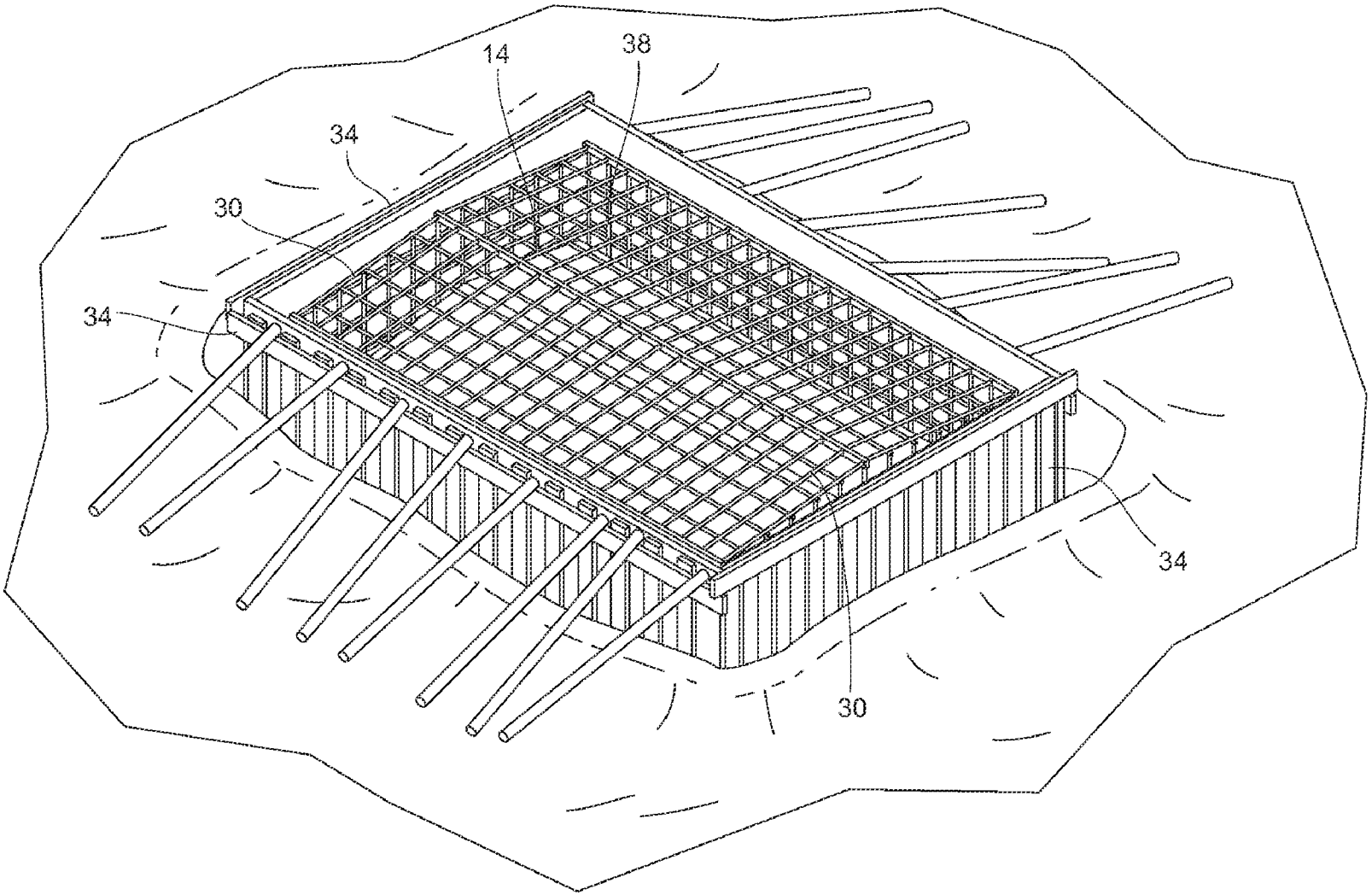
FIG. 8 is a perspective view showing a prefabricated unit set in a hole with outer formwork around the unit prior to pouring concrete for foundations, walls, and a roof.
Figure 9:
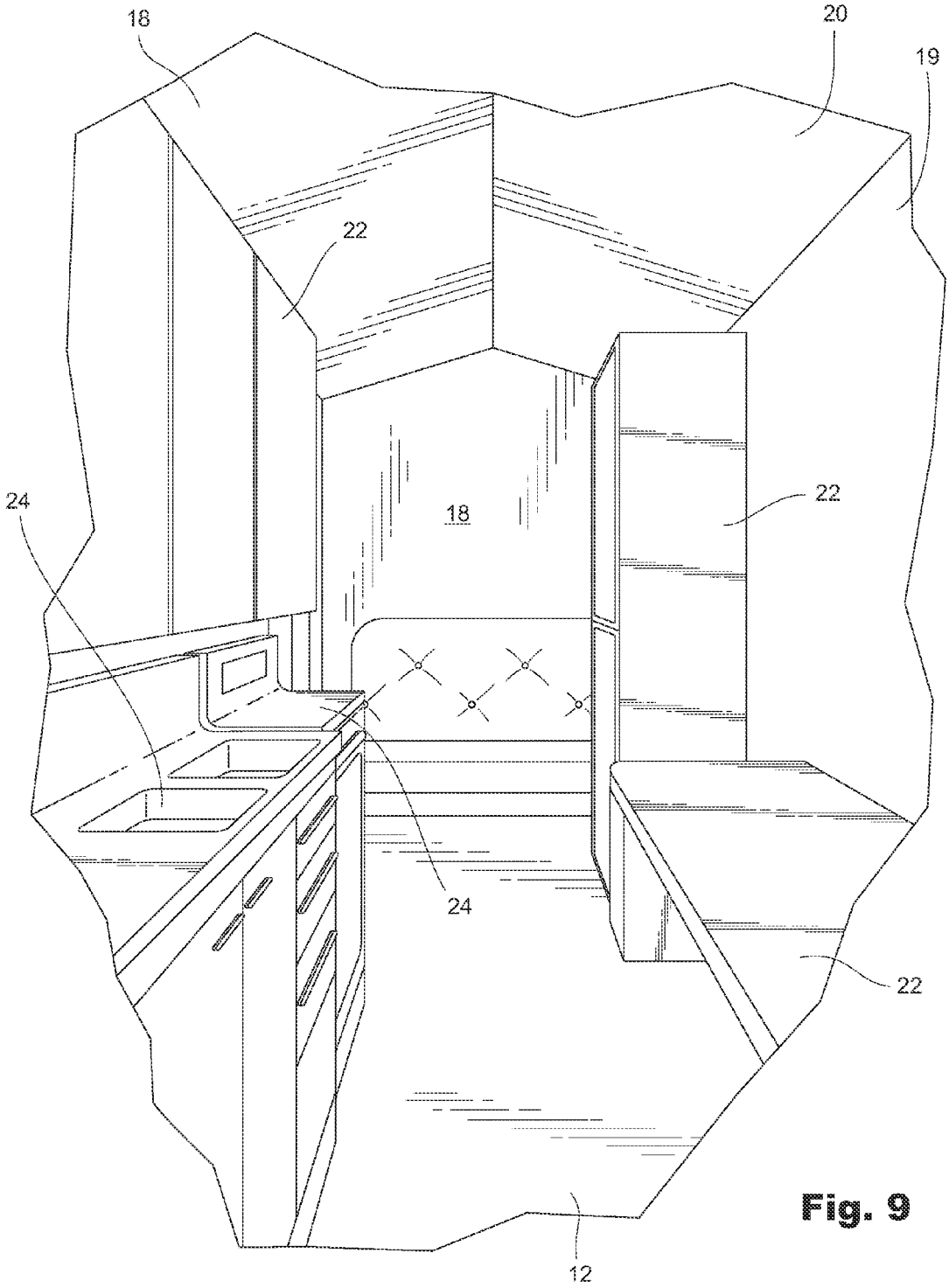
FIG. 9 is perspective internal view of the prefabricated unit.

The method of constructing a building of the present invention comprises roof and wall framework 10 on a floor 12 and then completing at least the essential internal components of the building before closing the building with an external wall 16 (not shown). Wallboard 18 is then installed on the framework 10 of the walls 19 and roof 14 forming at least one enclosed room with a ceiling 20.

Internal finishing components 22, such as cabinets, countertops, flooring, doors, trims and caseworks, electrical boxes, and bath fans are then mounted to the floor, walls and/or ceiling (or at least a portion of these components) directly onto the wallboard 18. Facilities fixtures 24 such as electrical wires and lighting, plumbing and plumbing fixtures, ducting and heating equipment and appliances are then installed with virtually open and virtually unrestricted access to the floor 12 and wall and roof framework 10 which makes installation efficient and error free. A functionality check of these installed and connected items is then performed while access is still available which makes fixes easy and routine, if necessary. The building prefabrication unit comprising these structures and installations is then complete and functional and ready for transport to, installation, and utilities connection at a final installation location.

Insulating foam 26 is installed around the framework 10 with plumbing pipes, heating and wire conduits embedded in the foam 26 to avoid contact between them and concrete to be poured afterward. A waterproofing membrane 28 is then installed outside of the foam 26 after the foam 26 has hardened, if spray foam used, which is normal, although rigid installation sheets can be employed as well. Reinforcing bars 30 are then installed around the foam 26 completing the prefabrication unit 32. These prior steps and installation are performed at a prefabrication factory remote from a final building location in a controlled and worker-friendly environment, making construction more convenient, efficient and less costly. The prefabrication unit 32 is then ready for shipment to the final building site.

After the prefabrication unit 32 is shipped to the final building location, external walls are installed. In the case of a concrete structure, concrete is poured around, under and over the prefabrication unit 32. Concrete formwork is placed around the reinforcing bars 30 as outer formwork 34. The hardened foam 26 insulates and when dry gives the walls 19 strength needed to support a concrete pour functions as inner formwork. Concrete is then the poured between the outer formwork 34 and the hardened foam 26.

Upon arriving at a final building location, the prefabrication unit 32 is placed over concrete footings 36, which are pre-cast at the factory and placed appropriately at the final building location. The footings 36 support the prefabrication unit 32 above the ground so when concrete is poured between the outer formwork 34 and the foam 26 the concrete flows around the footings 36 and under the prefabrication unit 32 forming a slab foundation. The concrete pour continues until the walls are formed. The pour continues until the concrete flows through reinforcing bars 30 and over the top 38 of the prefabrication unit 32 forming a roof 40. When the concrete is sufficiently dry, the outer formwork 34 is removed. Dirt is then backfilled against the foundation and at least a part of the concrete walls. If the building is intended for underground use, such as an underground shelter, then dirt is also added over the roof with appropriate entries and vents provided to the building.

In practice, the floor 12 is constructed at the prefabrication factory by attaching plywood sheets over floor joists. In fact, the floor joists are installed on the underside of the plywood and the floor is built upside down with the joists above the plywood. Plumbing pipes and electrical conduits are then installed between the floor joists (not shown). Insulation foam 26 or rigid insulation is then sprayed or installed between the joists on a floor underside, the water proof membrane 28 is installed over the floor underside, and reinforcing bars 30 are then installed on the floor underside over the membrane 28 therein completing the floor. The floor is then inverted with the joists under the plywood and wall and roof framework 10 is installed on the floor. Wallboard 18 is then installed on the walls and roof framework 10 and plaster 44 is applied to the installed wallboard 18 and the room or rooms are painted. The internal finishing components 22, facilities fixtures 24 and further finishing components 40, such as tables, nooks, shelves, and mirrors to the room walls and/or floors, are installed directly to the framework 10, wallboard 18 and floors 12 and all systems are tested.

The foam 26 is then installed in and around framework 10 and embeds the wires and ducting and pipes in the foam to protect them from the concrete pour. The waterproofing membrane 28 is then installed and external walls are then installed. Spray concrete can be applied over the membrane and over the reinforcing bars therein obviating a need for exterior formwork. If the roof is also concrete, it is poured over the foam protected by the membrane at the same time as the walls are poured. Nailing strips can be set to the formwork which imbeds the nailing strips into the concrete such that when the formwork is removed the strips remain and siding can be nailed to the strips over the concrete. Or decorative pre-cast slabs can be employed as the formwork or as the wall itself.

The invention claimed is:

1. A method of constructing a building, comprising the following steps:

a. constructing a floor by
   i. attaching plywood sheets over floor joists;
   ii. installing plumbing pipes and electrical conduits between the floor joists;
   iii. injecting or spraying insulation foam or installing rigid insulation between the joists on a floor underside,
   iv. applying a water proof membrane over the floor underside;
   v. installing reinforcing bars on the floor underside over the water proof membrane therein completing a floor;
b. after step a, installing walls on the floor;
c. after step b, installing roof framework on the walls over the floor;
d. after step c, installing wallboard on the walls and roof framework forming at least one enclosed room with a ceiling;
e. after step d, mounting at least a portion of the following directly onto the frame, floors and wallboard: cabinets, countertops, flooring and floor covering, doors, trims and caseworks, electrical boxes, and bath fans;
f. after step e, run and connect electrical wires, plumb fixtures, and install heating equipment;
g. after step f, performing a functionality check of installed and connected items;
h. after step g, spraying insulating foam to the walls and ceilings with pipes and wires embedded in the foam to avoid contact between them and concrete to be poured afterward;
i. after step h, applying a waterproofing membrane outside of foam on the walls and ceiling;
j. after step i, installing reinforcing bars around the walls, plumbing pipes and heating conduits forming a prefabrication unit;
k. after step j, the step of installing a foundation and external walls.

2. The method of claim 1 wherein step a includes laying plywood sheets upside down exposing their underside and installing floor joists on the underside of the plywood sheets.

3. The method of claim 1 wherein step d includes applying interior plaster to walls and ceiling of the at least one room.

4. The method of claim 3 including the step of painting the at least one room.

5. The method of claim 1 wherein step e includes installing sinks and appliances.

6. The method of claim 1 wherein step l includes pouring concrete for walls and roof at a same time.

7. The method of claim 6 including the step of installing temporary outer formwork around the prefabrication unit and pouring concrete between the foam and the outer formwork forming concrete walls around the prefabrication unit.

8. The method of claim 7 including the step of installing the prefabrication unit onto footings that support the prefabrication unit above the ground such that concrete poured between the outer formwork and the foam flows under the prefabrication unit therein forming a foundation supporting the prefabrication unit.

9. The method of claim 7 including the step of pouring concrete over the prefabrication unit and over the walls forming a concrete roof.

10. The method of claim 6 wherein the step of pouring concrete includes spraying a concrete layer in place onto the foam and over the reinforcing bars therein obviating a need for exterior formwork.

11. The method of claim 1 wherein steps a-k are performed at a fabrication site remote from a final building location and including the further step of moving the prefabrication unit to said final location.

12. The method of claim 1 including after step 3 the step of installing at least a portion of the following: tables, nooks, shelves, mirrors to the room walls and/or floors.

13. A method of constructing a building, comprising the following steps:

a. constructing a floor remote from a final building location by
   i. constructing plywood sheets over floor joists;
   ii. installing plumbing pipes and electrical conduits between the floor joists;
   iii. injecting or spraying insulation foam or installing rigid insulation between the joists on a floor underside,
   iv. applying a water proof membrane over the floor underside;
   v. installing reinforcing bars on the floor underside over the membrane therein completing a floor;
b. after step a, installing walls on the floor;
c. after step b, installing roof framework on the walls over the floor;
d. after step c, installing wallboard on the walls and roof framework forming at least one enclosed room with a ceiling;
e. after step d, mounting at least a portion of the following directly onto the wallboard: cabinets, countertops, flooring, doors, trims and caseworks, electrical boxes, and bath fans, walls and/or ceiling;
f. after step e, run and connect electrical wires, plumb fixtures, and install heating equipment;
g. after step f, performing a functionality check of installed and connected items;
h. after step g, spraying insulating foam to the walls and ceilings with pipes and wires embedded in the foam to avoid contact between them and concrete to be poured afterward;
i. after step h, applying a waterproofing membrane outside of the foam on the walls and ceiling;
j. after step i, installing reinforcing bars around the walls, plumbing pipes and heating conduits forming a prefabrication unit;
k. after step j, moving the prefabrication unit to the final building location;

l. after step k, the step of installing a foundation and external walls.

14. The method of claim 13 wherein step d includes applying interior plaster to walls and ceiling of the at least one room and painting the at least one room.

15. The method of claim 13 wherein step i includes attaching ties to said bars and adding formwork to the ties and pouring concrete for walls and roof at a same time.

16. The method of claim 13 wherein the step of pouring concrete includes spraying a concrete layer in place onto the foam and over the reinforcing bars therein obviating a need for exterior formwork.

* * * * *